US009410352B2

(12) United States Patent
Lee et al.

(10) Patent No.: US 9,410,352 B2
(45) Date of Patent: Aug. 9, 2016

(54) DOOR CLOSER PROVIDED WITH UNIT FOR ADDING DOOR-CLOSING FORCE

(71) Applicant: DAWON SDS CO., LTD, Seo-gu, Daegu (KR)

(72) Inventors: Joungwoo Lee, Daegu (KR); Jaebok Kang, Daegu (KR)

(73) Assignee: DAWON SDS CO., LTD, Seo-Gu, Daegu (KR)

( * ) Notice: Subject to any disclaimer, the term of this patent is extended or adjusted under 35 U.S.C. 154(b) by 0 days.

(21) Appl. No.: 14/649,031

(22) PCT Filed: Dec. 2, 2013

(86) PCT No.: PCT/KR2013/011061

§ 371 (c)(1),
(2) Date: Jun. 2, 2015

(87) PCT Pub. No.: WO2014/088274

PCT Pub. Date: Jun. 12, 2014

(65) Prior Publication Data

US 2015/0322705 A1 Nov. 12, 2015

(30) Foreign Application Priority Data

Dec. 3, 2012 (KR) ..... 10-2012-0139176

(51) Int. Cl.
*E05F 1/10* (2006.01)
*E05F 3/10* (2006.01)

(52) U.S. Cl.
CPC ..... *E05F 3/102* (2013.01); *E05F 1/105* (2013.01); *E05F 3/104* (2013.01); *E05Y 2800/22* (2013.01); *Y10T 16/2769* (2015.01); *Y10T 16/293* (2015.01); *Y10T 16/299* (2015.01)

(58) Field of Classification Search
CPC . Y10T 16/577; Y10T 16/2804; Y10T 16/285; Y10T 16/293; Y10T 16/585; Y10T 16/299; Y10T 16/286; Y10T 16/27; Y10T 16/2793; E05F 3/10; E05F 3/12; E05F 3/104; E05F 3/102; E05F 3/22; E05F 3/221; E05F 3/223; E05F 3/227; E05Y 2900/132
See application file for complete search history.

(56) References Cited

U.S. PATENT DOCUMENTS 1,595,722 A * 8/1926 Norton ..... E05F 3/102 16/281
1,595,723 A * 8/1926 Norton ..... E05F 3/102 16/354

(Continued)

FOREIGN PATENT DOCUMENTS

JP 11-081788 A 3/1999
JP 2881552 B2 4/1999

(Continued)

OTHER PUBLICATIONS

International Search Report of International Application No. PCT /KR2013/011061 mailed Feb. 12, 2014.

(Continued)

*Primary Examiner* — Chuck Mah
(74) *Attorney, Agent, or Firm* — K&L Gates LLP

(57) ABSTRACT

Disclosed is a door closer provided with a unit for adding door-closing force inside a housing. The disclosed door closer comprises a force-adding unit, which is included inside the housing, for adding the door-closing force. The force-adding unit comprises a cam which coaxially rotates with a link shaft inside the housing, and a cam pusher which is elastically compressed so as to come into close contact with the outer circumferential surface of the cam. The outer circumferential surface of the cam comprises an arc surface portion which is separated apart from a rotary axis of the cam at an equal distance, a concave surface portion which is separated apart from the rotary axis of the cam at a distance shorter than that to the arc surface portion, and one pair of protruding corner portions for connecting the arc surface portion and the concave surface portion. When the outer circumferential surface of the cam with which the cam pusher comes into close contact is converted from the arc surface portion to the concave surface portion due to the rotation of the cam, the rotational force of the link shaft is increased due to the elastic pressing force of the cam pusher.

5 Claims, 3 Drawing Sheets

(56) References Cited

U.S. PATENT DOCUMENTS

| | | | | | |
|---|---|---|---|---|---|
| 2,468,410 | A * | 4/1949 | Schacht | E05F 1/1253 | 16/55 |
| 2,680,263 | A * | 6/1954 | Hanssen | E05F 3/10 | 16/55 |
| 2,752,627 | A * | 7/1956 | Carlson | E05F 3/104 | 16/275 |
| 2,933,755 | A * | 4/1960 | Carlson | E05F 3/102 | 16/55 |
| 3,042,957 | A * | 7/1962 | Muessel | E05F 3/102 | 16/49 |
| 4,010,572 | A * | 3/1977 | Peterson | E05F 3/102 | 16/279 |
| 4,115,897 | A * | 9/1978 | Zunkel | E05F 3/102 | 16/49 |
| 4,378,612 | A * | 4/1983 | Beers | E05F 3/12 | 16/49 |
| 4,387,482 | A * | 6/1983 | Maublanc | E05F 3/10 | 16/62 |
| 4,660,250 | A * | 4/1987 | Tillman | E05F 1/006 | 16/58 |
| 5,272,787 | A * | 12/1993 | Salena | E05F 3/102 | 16/56 |
| 5,553,353 | A * | 9/1996 | Lin | E05F 3/06 | 16/59 |
| 8,966,712 | B1 * | 3/2015 | Yu | E05F 3/02 | 16/66 |
| 2002/0133904 | A1 * | 9/2002 | Donovan | E05F 3/16 | 16/49 |
| 2004/0074145 | A1 * | 4/2004 | Homberg | E05F 3/102 | 49/64 |
| 2004/0205930 | A1 * | 10/2004 | Huang | E05F 3/00 | 16/64 |
| 2005/0246860 | A1 * | 11/2005 | Huang | E05F 3/102 | 16/79 |
| 2005/0273975 | A1 * | 12/2005 | Foster | E05F 3/108 | 16/51 |
| 2007/0022664 | A1 | 2/2007 | Mahonen et al. | | |
| 2007/0033768 | A1 * | 2/2007 | Ginzel | E05F 3/04 | 16/71 |
| 2009/0051171 | A1 * | 2/2009 | Yamamuro | E05F 1/1041 | 292/163 |
| 2009/0320236 | A1 * | 12/2009 | Yamamuro | E05F 3/102 | 16/64 |
| 2010/0064472 | A1 * | 3/2010 | Busch | E05F 3/104 | 16/80 |

FOREIGN PATENT DOCUMENTS

| | | | |
|---|---|---|---|
| KR | 20-2000-0011289 | U | 6/2000 |
| KR | 10-2005-0090567 | A | 9/2005 |
| KR | 10-2010-0031008 | A | 3/2010 |
| KR | 10-2010-0100192 | A | 9/2010 |
| KR | 10-2011-0039084 | A | 4/2011 |
| KR | 10-2012-0019424 | A | 3/2012 |

OTHER PUBLICATIONS

International Search Report of International Application No. PCT /KR2013/011083 mailed Feb. 12, 2014.

* cited by examiner

DOOR CLOSER PROVIDED WITH UNIT FOR ADDING DOOR-CLOSING FORCE

CROSS-REFERENCE TO RELATED APPLICATION

This application is the United States National Stage of and claims priority to International Application No. PCT/KR2013/011061, which was filed Dec. 2, 2013, that claims priority to Korean Application No. 10-2012-0139176 filed Dec. 3, 2012, titled "DOOR CLOSER PROVIDED WITH UNIT FOR ADDING DOOR-CLOSING FORCE", both of which are incorporated herein by reference in their entirety.

TECHNICAL FIELD

The present invention relates to a door closer which automatically closes a hinged door by elastic force when the hinged door is opened.

BACKGROUND ART

A door closer is typically attached to a hinged door such as a front door, fire door, etc. of a house, apartment, officetel, etc. so as to automatically close the door by elastic force when it is opened. In a typical door closer, when the opening angle of the door increases, the expansion of a spring increases, and thus the elastic force increases. Due to the nature of this structure, when the door is almost closed as the door closer operates, the spring is restored to its original length from the state where it is fully expanded, which decreases the elastic force, and thus it is likely that the door is not completely closed.

In order to cope with this problem, door closers provided with a unit for adding door-closing force in a state where the door is almost closed are disclosed in prior art documents such as, for example, Japanese Patent No: 2881552, Korean Patent No: 823143, Korean Patent No: 823854, etc. However, the unit for adding door-closing force is attached to the outside of a housing of the door closer, which increases the size and weight of the door closer and the risk of failure.

DISCLOSURE

Technical Problem

An object of the invention is to provide a door closer which comprises a unit for adding door-closing force that is provided in a housing.

Moreover, another object of the invention is to provide a door closer which can be mounted to a door such that the door can be opened 180° without having to extend the length of a link even when a large spring is mounted to the inside of a housing to increase the elastic force.

Technical Solution

The present invention provides a door closer comprising: a housing which is fixed to a door; a link of which one end is connected to a door frame; a link shaft which is inserted into the housing, of which an upper end projecting to the outside of the housing is connected to the other end of the link, and which is elastically pressurized to rotate in a direction that the door is closed; and a power adding unit which adds power to close the door, the power adding unit comprises a cam which coaxially rotates with the link shaft in the housing and a cam pusher which is elastically pressurized to be in close contact with the outer circumferential surface of the cam, the outer circumferential surface of the cam comprises an arc surface portion which is spaced apart an equal distance from the rotation axis of the cam, a concave surface portion which is spaced apart a distance shorter than the arc surface portion from the rotation axis of the cam, and a pair of projection corner portions which connect the arc surface portion and the concave surface portion, and when the outer circumferential surface of the cam, with which the cam pusher comes into contact, is switched from the arc surface portion to the concave surface portion as the cam rotates, the rotation force of the link shaft is increased by the elastic pressing force of the cam pusher.

The door closer of the present invention may further comprise a pinion gear which coaxially rotates with the link shaft; a piston which extends in the longitudinal direction of the housing, is inserted into the housing to reciprocate in the longitudinal direction of the housing, and comprises a rack gear portion which is formed on one end thereof and engaged with the pinion gear; and a first coil spring which elastically pressurizes the piston such that the link shaft rotates in a direction that closes the door.

The piston may further comprise a piston base portion which is formed on the other end thereof and a piston body portion which connects the piston base portion and the rack gear portion, the first coil spring may be put on the piston body portion and may be compressed and accumulates elastic energy when the link shaft rotates in a direction that closes the door, in which one end of the first coil spring, which is relatively close to the link shaft, may be restricted to move toward the link shaft in the housing and the other end of the first coil spring, which is relatively far from the link shaft, may be pushed by the piston base portion and moves toward the link shaft such that the first coil spring is compressed.

A first spring hole, into which the first coil spring is inserted, a rack gear hole, through which the rack gear portion reciprocates and which has an inner diameter smaller than the inner diameter of the first spring hole and is connected to the first spring hole in a line, and a receiving groove, which has an inner diameter smaller than the inner diameter of the first spring hole and greater than the inner diameter of the rack gear hole, may be formed at the connection between the first spring hole and the rack gear hole in the housing, the door closer may further comprise a damping oil which is filled in the first spring hole and a sealing unit which prevents the damping oil from leaking to the rack gear hole, the sealing unit may comprise a ring-shaped sealing member which is tightly put on the outer circumferential surface of the piston body portion and a washer which has an outer diameter greater than the inner diameter of the rack gear hole, is put on the piston body portion to be located between the sealing member and the coil spring, and is pressurized toward the rack gear hole by the coil spring, and the sealing member may be pressurized toward the rack gear hole by the washer and received in the receiving groove.

The power adding unit may further comprise a second coil spring which elastically pressurizes the cam pusher to be in close contact with the cam and a spring support plug which supports the second coil spring in the housing, and the spring support plug may be configured to adjust the interval between the spring support plug and the cam pusher.

The cam pusher may comprise a rotation member which comes into contact with the outer circumferential surface of the cam and rotates with the rotation of the cam so as to reduce the friction against the cam.

Advantageous Effects

The door closer according to the present invention comprises a unit for adding door-closing force that is provided in the housing. Therefore, the door closer is smaller in size and lighter in weight. As a result, it is possible to mount the door closer to the door and reduce the risk of failure.

Moreover, even when a large spring is mounted to the inside of the housing to increase the elastic force, the door closer can be attached to the door such that the position of the link shaft is maintained a constant distance from the rotation axis of the door. Thus, the door can be opened 180° without having to extend the length of the link.

Furthermore, when the door closer is mounted to the door, the link shaft which is biased to one side of the housing can be located closer to the rotation axis of the door, thereby increasing the efficiency of the door closer.

MODE FOR INVENTION

Hereinafter, a door closer in accordance with an embodiment of the present invention will be described with reference to the accompanying drawings. The terminology used herein is for the purpose of properly describing preferred embodiments only and may be changed according to the intention or usage of a user or operator. Therefore, the terminology should be defined on the basis of the overall contents of this specification.

Figure 1:
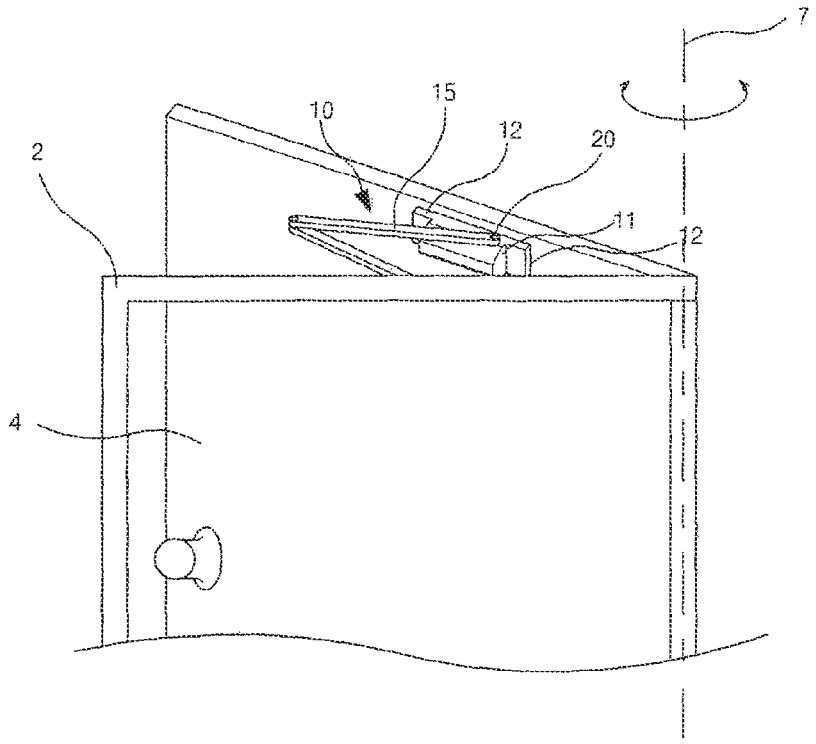
FIG. 1 is a perspective view showing a door to which a door closer in accordance with an embodiment of the present invention is mounted.

FIG. 1 is a perspective view showing a door to which a door closer in accordance with an embodiment of the present invention is mounted. Referring to FIG. 1, a door closer 10 in accordance with an embodiment of the present invention is attached to an upper surface of a hinged door 4 which is opened and closed by rotating with respect to a vertical rotation axis 7. Specifically, a pair of flanges 12 are fixedly attached to a housing 11 of the door closer 10 by means of screws. One end of a link 15, to which a pair of sticks are connected, is connected to an upper side of a door frame 2, and the other end of the link 15 is connected to an upper end of a link shaft 20 which penetrates the housing 11.

Figure 2:
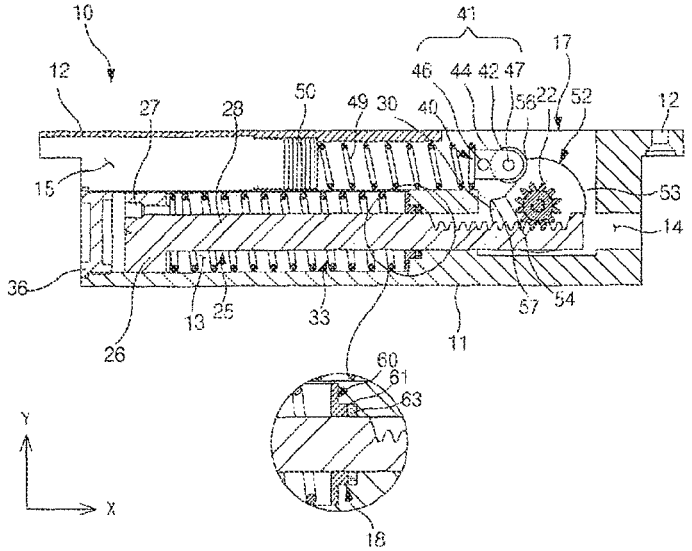
FIG. 2 is a cross-sectional view showing the inside of a housing of the door closer in FIG. 1.
Figure 3:
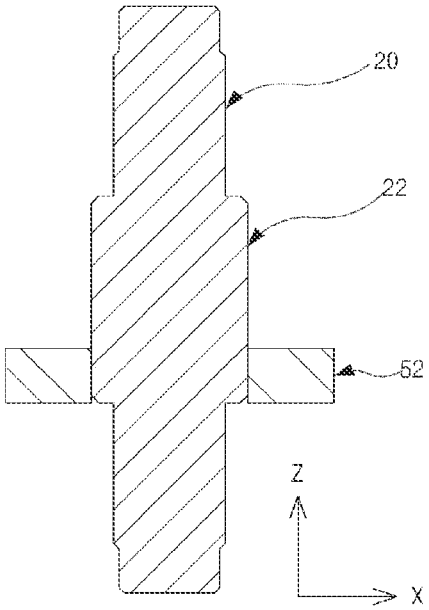
FIG. 3 is a longitudinal sectional view showing a link shaft in FIG. 2 and a cam connected thereto.

FIG. 2 is a cross-sectional view showing the inside of the housing of the door closer in FIG. 1, and FIG. 3 is a longitudinal sectional view showing the link shaft in FIG. 2 and a cam connected thereto. Referring to FIGS. 2 and 3, the door closer 10 in accordance with an embodiment of the present invention comprises a pinion gear 22, a piston 25, a first coil spring 33, and a power adding unit 40, which are provided in the housing 11.

The pinion gear 22 is formed on the outer circumferential surface of the link shaft 20 and coaxially rotates with the link shaft 20 with respect to the rotation axis of the link shaft 20 which is in parallel to the Z axis. The piston 25 extends in the longitudinal direction of the housing 11, i.e. in a direction parallel to the X axis, and is inserted into the housing 11 to reciprocate in the longitudinal direction of the housing 11. The piston 25 comprises a rack gear portion 30 which is formed on one end thereof and engaged with the pinion gear 22, a piston base portion 26 which is formed on the other end thereof, and a piston body portion 28 which connects the piston base portion 26 and the rack gear portion 30.

The first coil spring 33 is a compression spring which accumulates elastic energy upon compression and is put on the piston 25, specifically, on the piston body portion 28. When the piston base portion 26 moves towards the link shaft 20, i.e., when the piston 25 in which the rack gear portion 30 is engaged with the pinion gear 22 moves in the positive (+) direction of the X axis, the first coil spring 33 is compressed and accumulates elastic energy. At this time, the first coil spring 33 elastically pressurizes the piston 25 such that the link shaft 20 rotates in a direction that closes the door 4 (see FIG. 1).

The link shaft 20 and the pinion gear 22 are located on one side in the longitudinal direction of the housing 11 (in FIG. 2, the right side of the housing 11), and the first coil spring 33 and the piston base portion 26 are located on the other side in the longitudinal direction of the housing 11 (in FIG. 2, the left side of the housing 11). The first coil spring 33 and the piston 25 can be arranged to overlap each other in the housing 11, and thus the inside of the housing 11 can be configured compactly and can be reduced in size.

In the housing 11, a first spring hole 13, into which the first coil spring 33 is inserted, and a rack gear hole 14, through which the rack gear portion 30 reciprocates and which has an inner diameter smaller than the inner diameter of the first spring hole 13, are connected to each other in a line. The first coil spring 33 is inserted into the first spring hole 13, and then the piston 25 is inserted into the inside of the housing 11 through the first spring hole 13. The rack gear portion 30 passes through the first spring hole 13 and enters the rack gear hole 14. One end of the first coil spring 33 has an inner diameter that decreases at the boundary between the first spring hole 13 and the rack gear hole 14, and thus the movement of the first coil spring 33 in the positive (+) direction of the X axis is restricted. When the piston base portion 26 moves in the positive (+) direction of the X axis, the other end of the first coil spring 33 is pushed by the piston base portion 26 and moves in the same direction. Therefore, when the piston 25 moves in the positive (+) direction of the X axis, the first coil spring 33 is compressed, and when the piston 25 moves in the negative (−) direction of the X axis, the first coil spring 33 is expanded and restored.

According to the door closer 10 of the present invention, even when a large spring 33 is mounted in the housing 11 to increase the door-closing force, the door closer 10 can be attached to the door 4 such that the position of the link shaft 20 (see FIG. 3) is maintained a constant distance from the rotation axis 7 of the door 4.

In other words, the link can be fixed in a constant position to face the outside of the door at all times. Therefore, even when the length of the coil spring and the length of the link shaft are extended to increase the elastic force, it is not necessary to further extend the length of the link.

Therefore, it is possible to fully open the door 4 to 180° without having to extend the length of the link 15. Moreover, when the door closer 10 is mounted to the door 4, the link shaft 20, which is biased to one side of the housing 11, can be located closer to the rotation axis 7 of the door, thereby increasing the efficiency of the door closer 10.

The door closer 10 comprises a damping oil which is filled in the first spring hole 13 and a sealing unit which prevents the damping oil from leaking to the rack gear hole 14. The sealing unit comprises a sealing member 63 and a washer 60. The sealing member 63 is typically made of rubber and has a ring shape that is tightly put on the outer circumferential surface of the piston body portion 28. A U-packing having a U-shaped cross section may be used as the sealing member 63.

The washer 60 is made of metal, has an outer diameter greater than the inner diameter of the rack gear hole 14, and is put on the piston body portion 28 to be located between the sealing member 63 and the coil spring 33. The washer 60 is located in the first spring hole 13 and pressurized toward the rack gear hole 14 by the first coil spring 33. In the housing 11, a receiving groove 18 having an inner diameter smaller than the inner diameter of the first spring hole 13 and greater than the inner diameter of the rack gear hole 14 is formed at the connection between the first spring hole 13 and the rack gear hole 14, and the sealing member 63 is pressurized toward the rack gear hole 14 by the washer 60 and received in the receiving groove 18. The washer 60 comprises an inner circumferential projection 61 which projects so as to push the sealing member 63 to the inside of the receiving groove 18. Even when the piston 25 moves in the negative (−) direction of the X axis as well as in the positive (+) direction of the X axis, the washer 60 pressurized by the first coil spring 33 pressurizes the sealing member 63 toward the rack gear hole 14, and thus the sealing member 63 is not separated from the receiving groove 18, thereby preventing the leakage of the damping oil.

Moreover, an oil passage hole 27 is provided in the piston base portion 26. When the piston 25 moves in the positive (+) direction of the X axis, i.e., when the door 4 (see FIG. 1) is opened, the damping oil present at the first coil spring 33 in the first spring hole 13 moves toward a cap 36 through the oil passage hole 27 to delay the movement speed of the piston 25, thereby reducing the impact due to sudden opening of the door 4. Meanwhile, when the piston 25 moves in the negative (−) direction of the X axis, i.e., when the door 4 is closed, the damping oil present at the cap 36 in the first spring hole 13 moves toward the first coil spring 33 through the oil passage hole 27 to delay the movement speed of the piston 25, thereby reducing the impact due to sudden closing of the door 4.

The power adding unit 40 adds power to close the door when the door (see FIG. 1) is opened and then closed. The power adding unit 40 comprises a cam 52, a cam pusher 41, and a second coil spring 49. The cam 52 is fixedly connected to the bottom of the pinion gear 22 and coaxially rotates with the rotation axis of the link shaft 20 which is in parallel to the Z axis. The outer circumferential surface of the cam 52 comprises an arc surface portion 53 which is spaced apart an equal distance from the rotation axis of the cam 52, i.e., the rotation axis of the link shaft 20, a concave surface portion 54 which is spaced apart a distance shorter than the arc surface portion 53 from the rotation axis of the cam 52, and a pair of projection corner portions 56 and 57 which connect the arc surface portion 53 and the concave surface portion 54. A cam insertion groove 17 is provided in the housing 11 such that the cam 52 is installed therein, and the entrance of the cam insertion groove 17 is provided on the side facing the door 4.

The cam pusher 41 is elastically pressurized to be in close contact with the outer circumferential surface of the cam 52, and the second coil spring 49 elastically pressurizes the cam pusher 41 toward the cam 52. The cam pusher 41 comprises a rotation member 42, a support member 44, and first and second guide members 46 and 47. The rotation member 42 comes into contact with the outer circumferential surface of the cam 52 and rotates with the rotation of the cam 52 so as to reduce the friction against the cam 52. The support member 44 supports the rotation member 42. The first and second guide members 46 and 47 can move in a direction parallel to the X axis along a guide slot (not shown) formed in the housing 11 and guide the cam pusher 41 to move in a direction parallel to the X axis.

The second coil spring 49 is inserted into a second spring insertion hole 15 which is formed parallel to the first spring hole 13 in the housing 11. One side of the second coil spring 49 is supported by a spring support plug 50 which is fixed in the middle of the second spring insertion hole, and the other side elastically pressurizes the cam pusher 41. The spring support plug 50 is configured to adjust the interval between the spring support plug 50 and the cam pusher 41. Specifically, the spring support plug 50 is screw-connected to the second spring insertion hole 15 and moves in the positive (+) or negative (−) direction of the X axis in response to the rotation direction and amount with respect to the second spring insertion hole 15, thereby adjusting the interval between the spring support plug 50 and the cam pusher 41. Therefore, it is possible to adjust the magnitude of the door-closing force added by the power adding unit 40 by adjusting the magnitude of the elastic force of the second coil spring 49.

The link shaft 20 is biased to one side of the housing 11 in the longitudinal direction of the housing 11 (in FIG. 2, to the right side), and the second coil spring 49 is located on the other side of the housing 11 in the longitudinal direction of the housing 11 (in FIG. 2 on the left side of the link shaft 20) apart from the link shaft 20. Both the first coil spring 33 and the second coil spring 49 are disposed on the left side of the link shaft 20 (see FIG. 2), and thus the inside of the housing 11 can be configured compactly.

Figure 4:
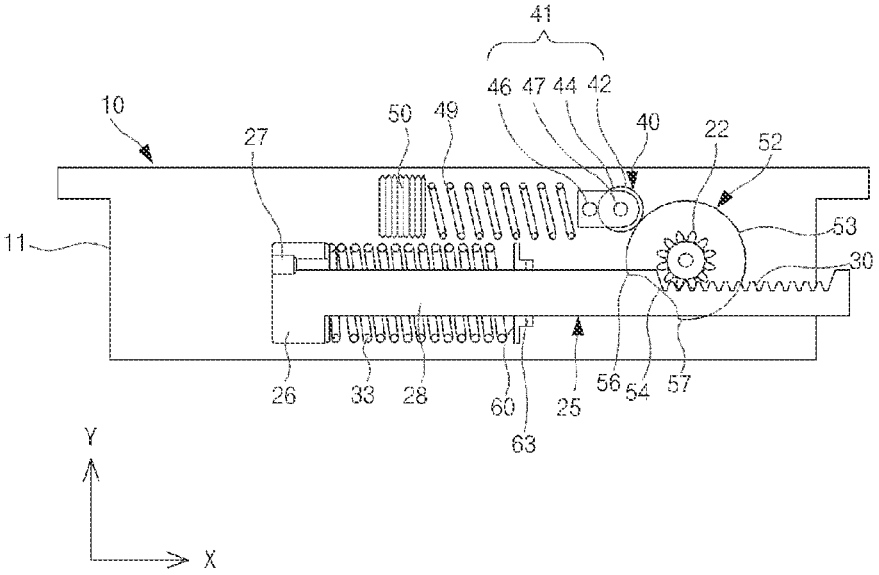
FIGS. 4 to 6 are cross-sectional views sequentially showing the change of the inside of the housing of the door closer in FIG. 2 while the door is closed.
Figure 5:
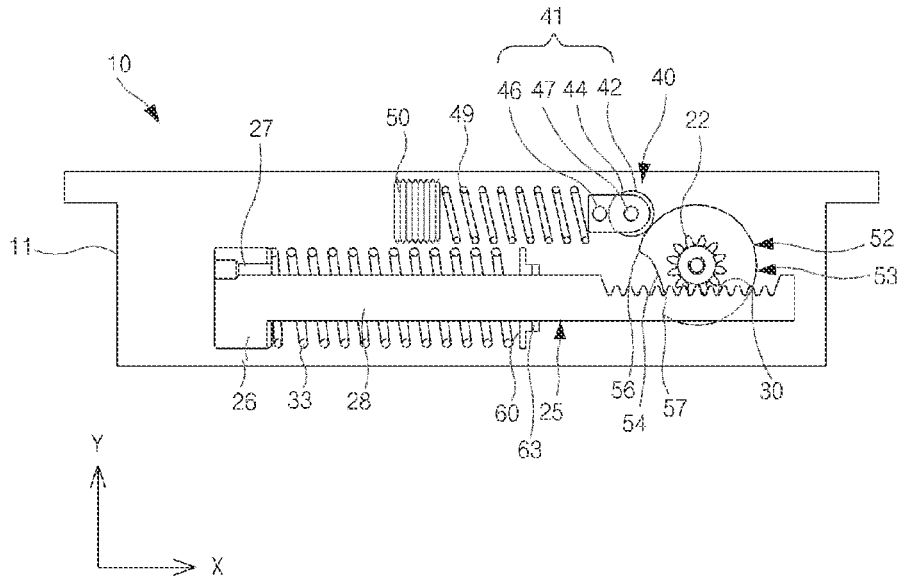
Figure 6:
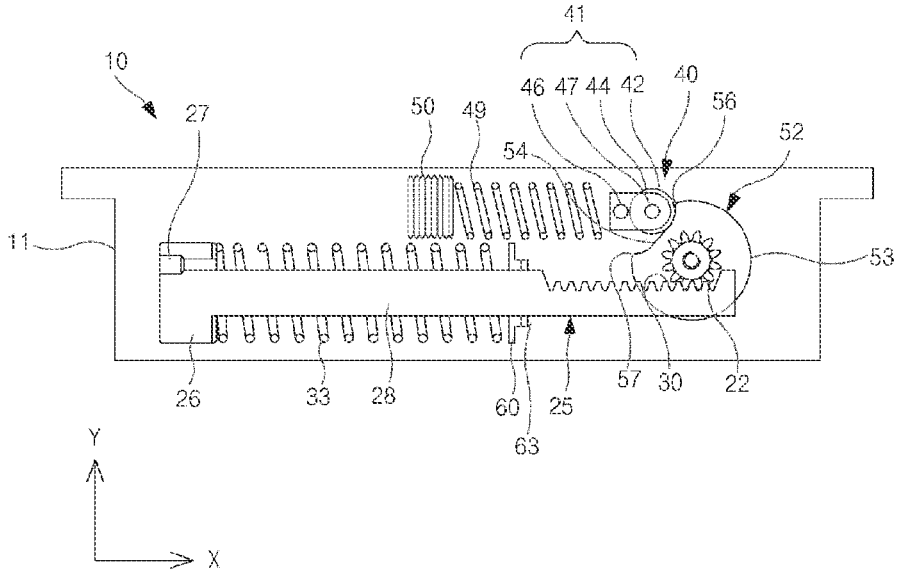

FIGS. 4 to 6 are cross-sectional views sequentially showing the change of the inside of the housing of the door closer in FIG. 2 while the door is closed, and the door closing operation by the door closer 10 will be described below by sequentially referring to FIGS. 2 and 4 to 6. First, the door 4 (see FIG. 1) is closed in FIG. 2, and when the door 4 is opened, the pinion gear 22 formed in the link shaft 20 (see FIG. 3) rotates in the counterclockwise direction, and as shown in FIG. 4, the piston 25 moves in the positive (+) direction of the X axis to the maximum. Referring to FIG. 4, the first coil spring 33 is compressed to its maximum, and as the cam 52 rotates in the counterclockwise direction, the cam pusher 41 comes into contact with the concave surface portion 54 of the cam 52 and then with the arc surface portion 53, and thus the second coil spring 49 is also compressed.

Referring to FIGS. 4 and 5, when the power to open the door 4 (see FIG. 1) is cancelled, the first coil spring 33 expands and elastically pressurizes the piston base portion 26 in the negative (−) direction of the X axis such that the piston 25 moves in the negative (−) direction of the X axis. Accordingly, the pinion gear 22 and the link shaft 20 rotate in the clockwise direction that the door 4 is closed. From the state of FIG. 4 to the state of FIG. 5, despite the rotation of the cam 52 in the clockwise direction rotation, the cam pusher 41 is brought into contact with the arc surface portion 53, and thus the second coil spring 49 is not further compressed or expanded.

Referring to FIGS. 5 and 6, when the door 4 (see FIG. 1) is almost closed, the elastic restoration force of the first coil spring 33 is reduced to less than the time of FIG. 4, and thus the door-closing force is reduced. However, due to the rotation of the cam 52 in the clockwise direction, the cam pusher 41 sequentially comes into contact with the arc surface portion 53, the first projection corner portion 56, and the concave surface portion 54. When the outer circumferential surface of the cam 52, with which the cam pusher 41 comes into contact, is switched from the arc surface portion 53 to the concave surface portion 54, the second coil spring 49 expands, and the rotation force in the clockwise direction of the link shaft 20 (see FIG. 3) coaxially connected to the cam 52 is increased by the elastic pressing force of the cam pusher 41. As a result, the door 4 is completely closed, and thus it is possible to prevent the introduction of foreign substances, gas, etc., through the door 4 slightly opened.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

INDUSTRIAL APPLICABILITY

The door closer of the present invention can be applied to various hinged doors of a house, apartment, officetel, etc.

The invention claimed is:

1. A door closer comprising:

a housing which is fixed to a door;

a link of which one end is connected to a door frame;

a link shaft which is inserted into the housing, of which an upper end projecting to the outside of the housing is connected to the other end of the link, and which is elastically pressurized to rotate in a direction that the door is closed; and a power adding unit which adds power to close the door, wherein the power adding unit comprises a cam which coaxially rotates with the link shaft in the housing and a cam pusher which is elastically pressurized to be in close contact with the outer circumferential surface of the cam, wherein the outer circumferential surface of the cam comprises an arc surface portion which is spaced apart an equal distance from the rotation axis of the cam, a concave surface portion which is spaced apart a distance shorter than the arc surface portion from the rotation axis of the cam, and a pair of projection corner portions which connect the arc surface portion and the concave surface portion, wherein when the outer circumferential surface of the cam, with which the cam pusher comes into contact, is switched from the arc surface portion to the concave surface portion as the cam rotates, the rotation force of the link shaft is increased by the elastic pressing force of the cam pusher, and wherein the door closer further comprises:

a pinion gear which coaxially rotates with the link shaft;

a piston which extends in the longitudinal direction of the housing, is inserted into the housing to reciprocate in the longitudinal direction of the housing, and comprises a rack gear portion which is formed on one end thereof and engaged with the pinion gear; and a first coil spring which elastically pressurizes the piston such that the link shaft rotates in a direction that closes the door.

2. The door closer of claim 1, wherein the piston further comprises a piston base portion which is formed on the other end thereof and a piston body portion which connects the piston base portion and the rack gear portion, wherein the first coil spring is put on the piston body portion and is compressed and accumulates elastic energy when the link shaft rotates in a direction that opens the door, and wherein one end of the first coil spring, which is relatively close to the link shaft, is restricted to move toward the link shaft in the housing and the other end of the first coil spring, which is relatively far from the link shaft, is pushed by the piston base portion and moves toward the link shaft such that the first coil spring is compressed.

3. The door closer of claim 2, wherein a first spring hole, into which the first coil spring is inserted, a rack gear hole, through which the rack gear portion reciprocates and which has an inner diameter smaller than the inner diameter of the first spring hole and is connected to the first spring hole in a line, and a receiving groove, which has an inner diameter smaller than the inner diameter of the first spring hole and greater than the inner diameter of the rack gear hole, is formed at the connection between the first spring hole and the rack gear hole in the housing, wherein the door closer further comprises a damping oil which is filled in the first spring hole and a sealing unit which prevents the damping oil from leaking to the rack gear hole, wherein the sealing unit comprises a ring-shaped sealing member which is tightly put on the outer circumferential surface of the piston body portion and a washer which has an outer diameter greater than the inner diameter of the rack gear hole, is put on the piston body portion to be located between the sealing member and the coil spring, and is pressurized toward the rack gear hole by the coil spring, and wherein the sealing member is pressurized toward the rack gear hole by the washer and received in the receiving groove.

4. The door closer of claim 1, wherein the power adding unit further comprises a second coil spring which elastically pressurizes the cam pusher to be in close contact with the cam and a spring support plug which supports the second coil spring in the housing, and wherein the spring support plug is configured to adjust the interval between the spring support plug and the cam pusher.

5. The door closer of claim 1, wherein the cam pusher comprises a rotation member which comes into contact with the outer circumferential surface of the cam and rotates with the rotation of the cam so as to reduce the friction against the cam.

* * * * *